US009603420B2

(12) United States Patent
Walsh

(10) Patent No.: US 9,603,420 B2
(45) Date of Patent: Mar. 28, 2017

(54) SYSTEMS AND METHODS FOR UMBRELLA/PARASOL/PERSONAL SUNSHADE CLOSURE

(71) Applicant: Lisa Marie Walsh, Novato, CA (US)

(72) Inventor: Lisa Marie Walsh, Novato, CA (US)

( * ) Notice: Subject to any disclaimer, the term of this patent is extended or adjusted under 35 U.S.C. 154(b) by 0 days.

(21) Appl. No.: 14/120,165

(22) Filed: Apr. 30, 2014

(65) Prior Publication Data

US 2015/0082829 A1 Mar. 26, 2015

Related U.S. Application Data

(60) Provisional application No. 61/817,826, filed on Apr. 30, 2013.

(51) Int. Cl.
*A44C 5/00* (2006.01)
*A45B 25/12* (2006.01)

(52) U.S. Cl.
CPC ..... *A44C 5/0007* (2013.01); *A45B 25/12* (2013.01)

(58) Field of Classification Search
CPC ..... A45B 25/12; A44C 5/0007; A44C 9/0061; A44C 15/003
USPC .... 63/1.11, 1.12, 1.18, 3; 135/16, 37, 39, 44
See application file for complete search history.

(56) References Cited

U.S. PATENT DOCUMENTS

| | | | | | |
|---|---|---|---|---|---|
| 403,355 | A * | 5/1889 | Lumley | 135/44 |
| 681,405 | A * | 8/1901 | Bealmear | 135/44 |
| 686,090 | A * | 11/1901 | Krekel | 24/299 |
| 1,352,332 | A * | 9/1920 | Weinberg | 135/44 |
| 1,425,806 | A * | 8/1922 | Swift | 135/37 |
| 1,514,962 | A * | 11/1924 | Grimaldi | 24/579.09 |
| 1,601,605 | A * | 9/1926 | Talbert | 24/17 R |
| 2,263,384 | A * | 11/1941 | Grimaldi | 24/572.1 |
| 3,958,306 | A * | 5/1976 | Kuusisto | 24/299 |
| 5,584,195 | A * | 12/1996 | Liu | 63/1.12 |
| 2013/0213089 | A1 * | 8/2013 | Gagne | 63/1.12 |

* cited by examiner

*Primary Examiner* — Abigail Morrell
(74) *Attorney, Agent, or Firm* — Garrett James O'Sullivan

(57) ABSTRACT

A bracelet or other type of body jewelry, such as a necklace, an anklet, a belly chain, or earrings, secures the canopy of the umbrella, parasol, or personal sunshade in place and closed when not in use. A method of closure eliminates the need for snaps, straps, Velcro, buttons, etc. on the umbrella's canopy. The user slides the bracelet, or other type of body jewelry, onto the canopy to keep the canopy closed, and slides the jewelry off of the canopy and puts it on their wrist, or other body part, when they want to open and use the umbrella, parasol, or personal sunshade.

8 Claims, 2 Drawing Sheets

SYSTEMS AND METHODS FOR UMBRELLA/PARASOL/PERSONAL SUNSHADE CLOSURE

CROSS-REFERENCE TO RELATED APPLICATION

The present application claims priority to U.S. Provisional Patent Application No. 61/817,826 filed on Apr. 30, 2014, entitled "Systems and Methods for Umbrella/Parasol/Personal Sunshade Closure", the entire disclosure of which is incorporated by reference herein.

BACKGROUND OF THE INVENTION

1. Field of Invention

The present invention relates to methods and apparatuses for securing the canopy of an umbrella, parasol, or personal sunshade in a closed position.

2. Description of Related Art

Canopies for umbrellas, parasols, and sunshades are secured in a closed position using devices that either engage with the rib tips or that are integrated into the canopy. Most modern umbrellas have a strap stitched, or otherwise affixed, to the canopy that is used to wrap around and retain the canopy.

While useful, the aforementioned means of securing an umbrella in a closed position have a number of drawbacks. For example, a device that engages with an umbrella's rib tips would, by its nature, be a very small device that could easily be lost or broken. Additionally, a rib tip device would be apt to damaging the surface of the ribs and/or the umbrella handle in the repeated process of removing it from, and replacing it on, the rib tips. Finally, if removed from the umbrella, a rib tip device would need to be stored, e.g. in a user's pocket or purse, creating a nuisance and further increasing the chances of the device being lost or damaged.

With respect to closure means, such as straps, integrated into the canopy, the fastening means, such as Velcro or snaps become worn, i.e. less effective, with use over time. Additionally, integrated straps are susceptible to being caught or snagged on an object, which could result in either the strap breaking or the canopy being torn as the user pulls on the umbrella.

Based on the foregoing, there is a need in the art for a device that engages with a canopy and secures an umbrella or sunshade in a closed position, while preventing harm to the canopy and allowing an easy and convenient storage solution when the device is removed from the umbrella.

SUMMARY OF THE INVENTION

A bracelet for retaining an umbrella canopy in a closed position has a smooth inner surface that engages with an outer surface of the canopy. The bracelet is removable from the umbrella and can be worn on a user's body when not engaged with the canopy.

In an embodiment, the bracelet has one or more mechanisms for opening and closing the bracelet.

In an embodiment, the bracelet wraps around the canopy one or more times.

A method of using the bracelet as a umbrella canopy retention device includes the steps of: (1) removing the bracelet from a user's wrist; (2) inserting an upper end of a closed umbrella through an aperture extending through the bracelet, the aperture defined by an inner surface of the bracelet; (3) lowering the bracelet onto the canopy, wherein the bracelet is configured to retain the canopy in a closed position; (4) removing the bracelet from the canopy when the user is ready to open the canopy; and (5) putting the bracelet back onto the user's wrist.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
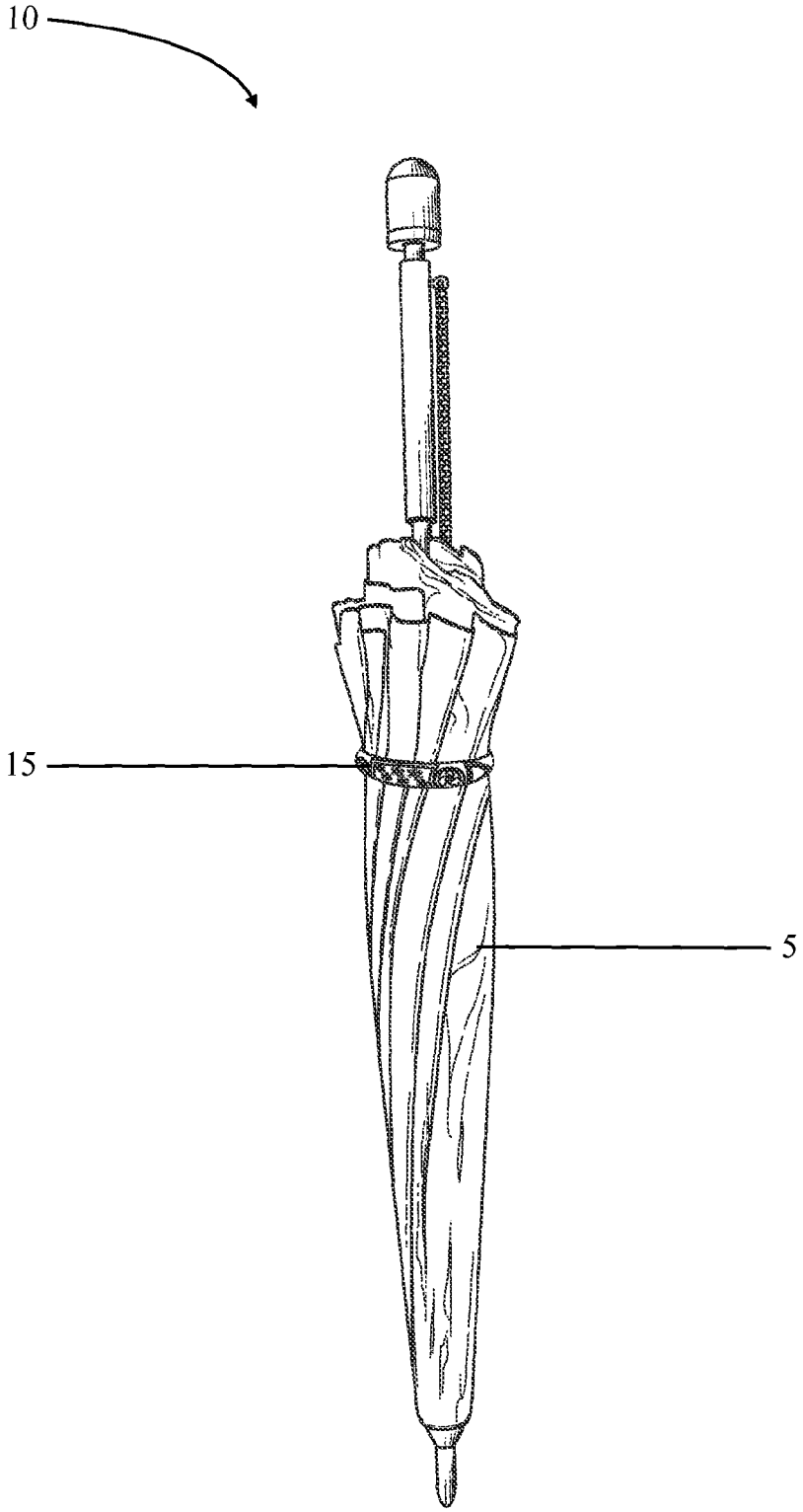
FIG. 1 is a perspective view of a bracelet securing an umbrella in a closed position, according to an embodiment of the present invention.
Figure 2:
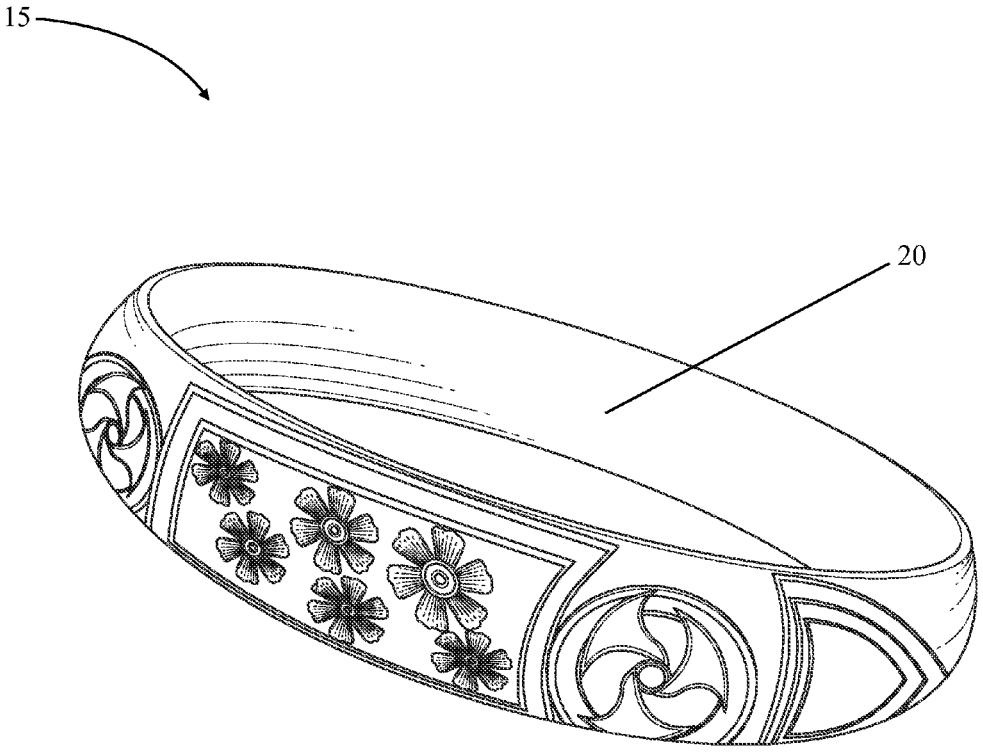
FIG. 2 is a perspective view of the bracelet of FIG. 1, according to an embodiment of the present invention.

Preferred embodiments of the present invention and their advantages may be understood by referring to FIGS. 1-2 wherein like reference numerals refer to like elements.

With reference to FIG. 1, in an embodiment, the canopy 5 of the umbrella 10, i.e., an umbrella, parasol, or personal sunshade, is held closed using body jewelry 15. The jewelry 15 may include, but is not limited to: bracelets in metal, crystal, jewels, stretchy materials, precious and semi-precious metals, and jewels; anklets; necklaces; belly chains; rings; cuffs; and bangles. The canopy 5 is closed by sliding the jewelry 15 onto the canopy 5. The jewelry 15 secures the canopy 5 in place when the umbrella 10 is closed or not in use. In an embodiment, the umbrella 10 has an attached closure (not shown), such as a strap attached to the umbrella 10 that may also be engaged around a closed umbrella 10 to keep the umbrella 10 closed when not in use.

In an embodiment, in order to open the umbrella 10, the user slides the jewelry 15 off the canopy 5 to the user's wrist. The canopy 5 may then be opened.

Those skilled in the art will appreciate that the jewelry 15 may be removed from the canopy 5, allowing the canopy 5 to be opened, in any number of ways. For example, the jewelry 15 may include one or more clasps or snaps (not shown) that may be opened to remove the jewelry from the canopy 5. The jewelry 15 may then be used to adorn the user's body, e.g., it may be clasped around any body part of the user such as the wrist, ankle, waist, arm, leg, neck or head. The jewelry 15 may allow for any mechanism or combination of mechanisms (not shown), e.g., hooks, magnets, clasps, snaps, or the like, to open or close the jewelry 15. In an embodiment, the jewelry 15 may be used to adorn clothing, other jewelry, a purse, a briefcase, boots and/or other accessories of the user.

Although FIG. 1 depicts a single strand around the canopy 5, those skilled in the art will appreciate that the jewelry 15 may wrap around the canopy 5 multiple times. For example, a bracelet may wrap four times around the user's wrist and wrap three times around the canopy 5 of the umbrella 10.

In an embodiment, the jewelry 15 is strong enough to hold the canopy 5 closed without damaging the canopy 5.

In an embodiment, the jewelry 15 is configured to hold the canopy 5 firmly closed while not being too tight to avoid deformation of spines or ribs (not shown) of the canopy 5 over time. In an embodiment, the jewelry 15 holds the canopy 5 firmly closed while not being too tight to avoid rubbing tips of the ribs (not shown) of the umbrella 10 against the shaft, ornamentation, or other feature of the umbrella 10 to avoid damage to the tips, shaft, ornamentation, and/or other features.

With additional reference to FIG. 2, in an embodiment, the jewelry 15 is smooth on the inside 20 so as not to snag the material of the canopy 5 and/or any other parts of the umbrella 10.

It should be noted that the term "umbrella" as used herein is used in a generic sense and should be construed under its broadest reasonable interpretation to include other similar devices, such as a parasol or personal sunshade.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

I claim:

1. A method of using jewelry as an umbrella canopy retention device, the method comprising the steps of:

a. a user wearing the jewelry, wherein the jewelry has a circumference, wherein the jewelry is circumferencially and removeably engaged with the user;

b. the user removing the jewelry from at least one of the user's body parts;

c. securing the jewelry around a canopy to retain the canopy in a closed position, wherein the jewelry comprises a smooth interior, wherein the smooth interior contacts the canopy, wherein the smooth interior prevents the jewelry from snagging the canopy, and wherein securing the jewelry around the canopy comprises the steps of:

i. inserting an upper end of an umbrella through an aperture defined by the circumference of the jewelry; and ii. lowering the jewelry onto the canopy;

d. removing the jewelry from the canopy when the user is ready to open the canopy; and e. putting the jewelry onto the at least one body part.

2. The method of claim 1, wherein the step of removing the jewelry from the canopy comprises the step of sliding the jewelry off of the canopy.

3. The method of claim 1, wherein the jewelry is selected from the group consisting of an anklet, a necklace, a belly chain, an earring, a ring, a cuff, or a bangle.

4. The method of claim 3, wherein if the jewelry is the necklace, the at least one body part is the user's neck.

5. The method of claim 4, wherein if the jewelry is the earring, the at least one body part is the user's ear.

6. The method of claim 5, wherein if the jewelry is the belly chain, the at least one body part is the user's belly.

7. The method of claim 3, wherein the jewelry comprises one or more clasps, and wherein the step of the user removing the jewelry from the at least one body part further comprises the steps of:

a. the user opening the one or more clasps, wherein the one or more clasps are opened to facilitate removal of the jewelry from the user;

b. the user closing the one or more clasps prior to securing the jewelry around the canopy to retain the canopy in the closed position.

8. The method of claim 3, wherein the step of securing the jewelry around the canopy to retain the canopy in the closed position, further comprises the step of:

after inserting the upper end of the umbrella, the user wrapping the jewelry multiple times around the canopy.

* * * * *